US009914629B2

(12) United States Patent
Zacche'

(10) Patent No.: US 9,914,629 B2
(45) Date of Patent: Mar. 13, 2018

(54) VARIABLE FLOW DISPENSING VALVE

(71) Applicant: WEIGHTPACK S.R.L., Goito (Mantova) (IT)

(72) Inventor: Vanni Zacche', Goito (IT)

(73) Assignee: WEIGHTPACK S.R.L., Goito Mantova (IT)

( * ) Notice: Subject to any disclaimer, the term of this patent is extended or adjusted under 35 U.S.C. 154(b) by 27 days.

(21) Appl. No.: 15/200,315

(22) Filed: Jul. 1, 2016

(65) Prior Publication Data

US 2017/0029260 A1 Feb. 2, 2017

(30) Foreign Application Priority Data

Jul. 30, 2015 (IT) ..... 102015000040436

(51) Int. Cl.
*B65B 31/00* (2006.01)
*B67C 3/28* (2006.01)
*B67C 3/00* (2006.01)

(52) U.S. Cl.
CPC ..... *B67C 3/286* (2013.01); *B67C 3/007* (2013.01)

(58) Field of Classification Search
CPC ..... B67C 3/286; B67C 3/007
See application file for complete search history.

(56) References Cited

U.S. PATENT DOCUMENTS

| | | | |
|---|---|---|---|
| 3,908,717 | A | 9/1975 | Rademacher et al. |
| 5,232,023 | A | 8/1993 | Zimmerly |
| 5,469,880 | A | 11/1995 | Zimmerly |
| 5,878,992 | A | 3/1999 | Edwards et al. |

FOREIGN PATENT DOCUMENTS

| | | |
|---|---|---|
| DE | 729 224 C | 12/1942 |
| EP | 0559513 | 9/1993 |
| FR | 2736339 | 1/1997 |
| JP | 3 808574 B2 | 9/1975 |
| WO | WO 01/40098 A1 | 6/2001 |

OTHER PUBLICATIONS

International Search Report for application No. IT UB20152677; The Hague; Mar. 17, 2016; 7 pages.
International Search Report for application No. PCT/FR00/03214; European Patent Office, Rijswijk The Netherlands, Mar. 13, 2001; 4 pages.

*Primary Examiner* — Jason K Niesz
(74) *Attorney, Agent, or Firm* — Thomas Horstemeyer, LLP

(57) ABSTRACT

The present invention relates to a variable flow valve, in particular for filling with a foaming fluid. Preferably, but not exclusively, the valve of the invention can be used in net weight filling machines.

In particular, the invention relates to a filling valve (1) for filling machines comprising a hollow body (2) which encloses a cavity (4) in which a filling fluid is introduced and which opens at its bottom into a dispensing opening (5), a shutter (3) being axially sliding in the cavity (4), wherein the shutter (3) comprises a tip (6), adapted to shut the dispensing opening (5), a stem (7) and an adjusting member (16) for adjusting the flow rate of the filling fluid, characterized in that the adjusting member (16) comprises a toroidal body (17) arranged coaxially with respect to the stem (7) and floating with respect thereto.

12 Claims, 7 Drawing Sheets

VARIABLE FLOW DISPENSING VALVE

CROSS-REFERENCE TO RELATED APPLICATIONS

The present application claims priority and is a continuation application of Italian Application Number 102015000040436, entitled "VARIABLE FLOW DISPENSING VALVE", filed Jul. 30, 2015, the contents of all of which are incorporated by reference as if fully set forth herein.

The present invention relates to a variable flow valve, in particular for filling with a foaming fluid. Preferably, but not exclusively, the valve of the invention can be used in net weight filling machines.

The filling of containers with foaming fluids, i.e. which tend to form thick foams when subjected to turbulence, requires particular contrivances. Examples of such fluids are found among beverages, such as for example milk derivatives and fruit juices, and among liquids for domestic or industrial use, such as detergents and soaps.

If a conventional filling valve is used with this type of fluids, a sudden formation of foam is obtained, which foam immediately tends to spill out from the container.

Variable delivered-flow filling valves have thus been designed: the dispensing opening of the valve is minimum at the beginning and at the end of the operation of filling a container, so that the fluid flow is sufficiently reduced to not cause, or at least to minimize, the formation of foam, and the flow is increased in the central step of filling in order to ensure industrially acceptable filling times. Indeed, it has been found that the formation of foam is actually promoted by sudden changes in the filling fluid flow rate.

A filling valve of this type is shown in FIG. 5 and comprises a shutter A having a stem B which slides at a narrowing C of the cavity in which the fluid flows and which has a section D with smaller diameter immediately under such a narrowing. At the narrowing C there is a gap between the cavity wall and the surface of stem B, so as to create a toroidal channel which is sufficient for a liquid flow to pass at a slow flow rate when shutter A is raised. However, when the raising of shutter A continues, i.e. during the central step of filling, the smaller diameter section D of stem B is at the narrowing C, so that the section of the toroidal channel increases and the liquid flow reaches the optimal flow rate for a quick filling. During the step of closing, instead, stem B with larger diameter engages the narrowing C of the dispensing cavity again, thus causing a decrease in the toroidal channel section and a consequent reduction of the fluid flow rate.

This mechanism ensures a filling with a low formation of foam even with the most foaming liquids. Although the described device is substantially suited to the function it must perform, it may encounter a drawback which limits its efficiency and versatility of use. Indeed, some fluids, such as for example fruit juices, may have small particles, filaments or clumps in suspension. Such suspensions may get caught in the thin toroidal channel between narrowing C and stem B when the latter is lowered during the final step of dispensing, thus causing the seizing of the shutter.

Therefore, the problem addressed by the present invention is that to provide a variable dispensed-flow filling valve which solves the inherent problems of the devices of the prior art and which allows the quick and effective filling of containers with foaming fluids.

Such a problem is solved by a variable dispensed-fluid filling valve as outlined in the appended claims, the definitions of which are an integral part of the present description.

Further features and advantages of the present invention will become apparent from the description of some embodiments, given hereinbelow by way of non-limiting example, with reference to the following figures.

Figure 1:
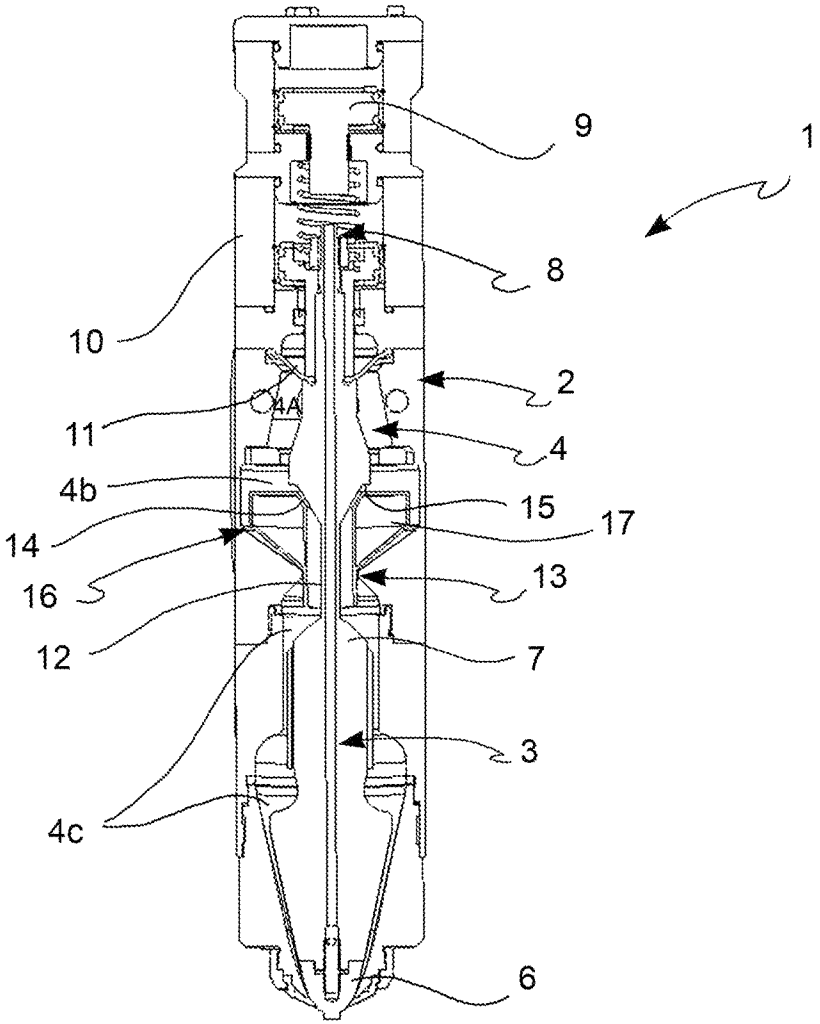
FIG. 1 shows a longitudinal section view of the valve of the invention in a non-operating condition (valve empty)

With reference to figures from 1 to 4B, reference numeral 1 indicates a filling valve according to the invention. Valve 1 comprises a hollow body 2 which encloses a cavity 4 in which a filling fluid is introduced and which opens at its bottom into a fluid dispensing opening 5 (shown in greater detail in FIGS. 3A-4B). A shutter 3 is axially sliding in cavity 4.

Figure 2:
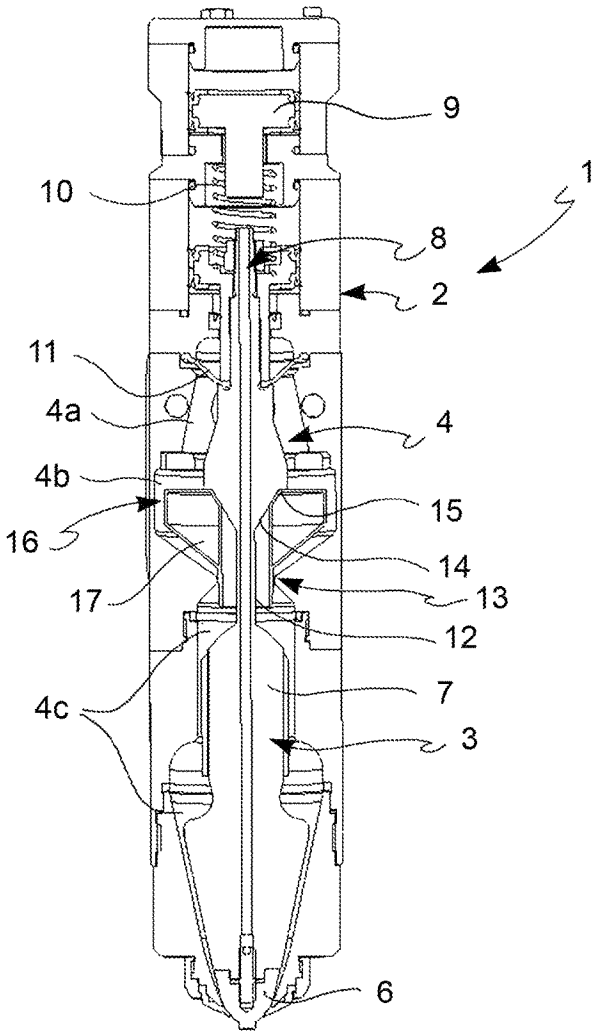
FIG. 2 shows a longitudinal section view of the valve in FIG. 1 in the operating closing condition (valve full of fluid)

Shutter 3 comprises a substantially ogival tip 6 intended to shut the dispensing opening 5 (as shown in FIGS. 1 and 2), and a stem (7).

Stem 7 has an upper portion 8 operatively connected to actuation means 9 of shutter 3. The actuation means 9 may be, for example, a pneumatic actuator or a direct drive linear motor, such as a linear brushless motor.

The upper portion 8 of stem 7 rests on preloaded elastic means 10, typically a spiral spring, to keep shutter 3 in closing position (FIGS. 1 and 2).

The upper portion 8 of stem 7 is separated from the cavity 4 of body 2 by means of an annular-shaped sealing membrane 11, the outer perimeter of which is fixed to the inner wall of body 2, while the inner perimeter is fixed to stem 7. The elastic properties and shape of the sealing membrane 11 are such that it can be deformed when shutter 3 moves upwards or downwards in the various operating conditions of valve 1.

Under the sealing membrane 11, cavity 4 comprises a first portion 4*a* for introducing the filling fluid, a second funnel portion 4*b* and a third dispensing portion 4*c*, which ends at its bottom in the dispensing opening 5.

The first portion 4*a* of cavity 4 has an opening (not shown in the figures) which can be connected to an introduction pipe for the filling fluid coming from a specific tank.

Between the first portion 4*a* and the second portion 4*b* of cavity 4, the inner surface of body 2 forms a downward-facing shoulder 26.

Cavity 4 has a cross-section narrowing 13 between the second funnel portion 4*b* and the third dispensing portion 4*c*.

The stem 7 according to the invention has a reduced-section portion 12 at the narrowing 13 of cavity 4. Stem 7 has a conical portion 14 which ends on its top with a shoulder 15 above the reduced-section portion 12.

Shutter 3 comprises an adjusting member 16 for adjusting the flow rate of the filling fluid.

The adjusting member 16 comprises a toroidal body 17 arranged coaxially with respect to the reduced-section portion 12 and floating with respect thereto.

Figure 3A:
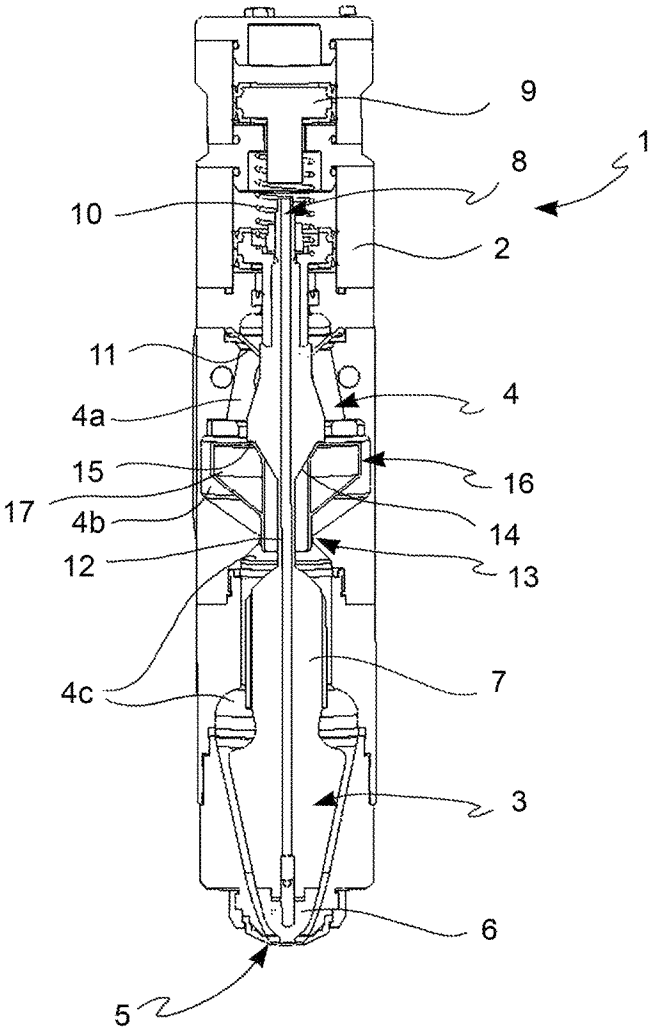
FIG. 3A shows a longitudinal section view of the valve in FIG. 1 in a first opened-valve operating condition.
Figure 3B:
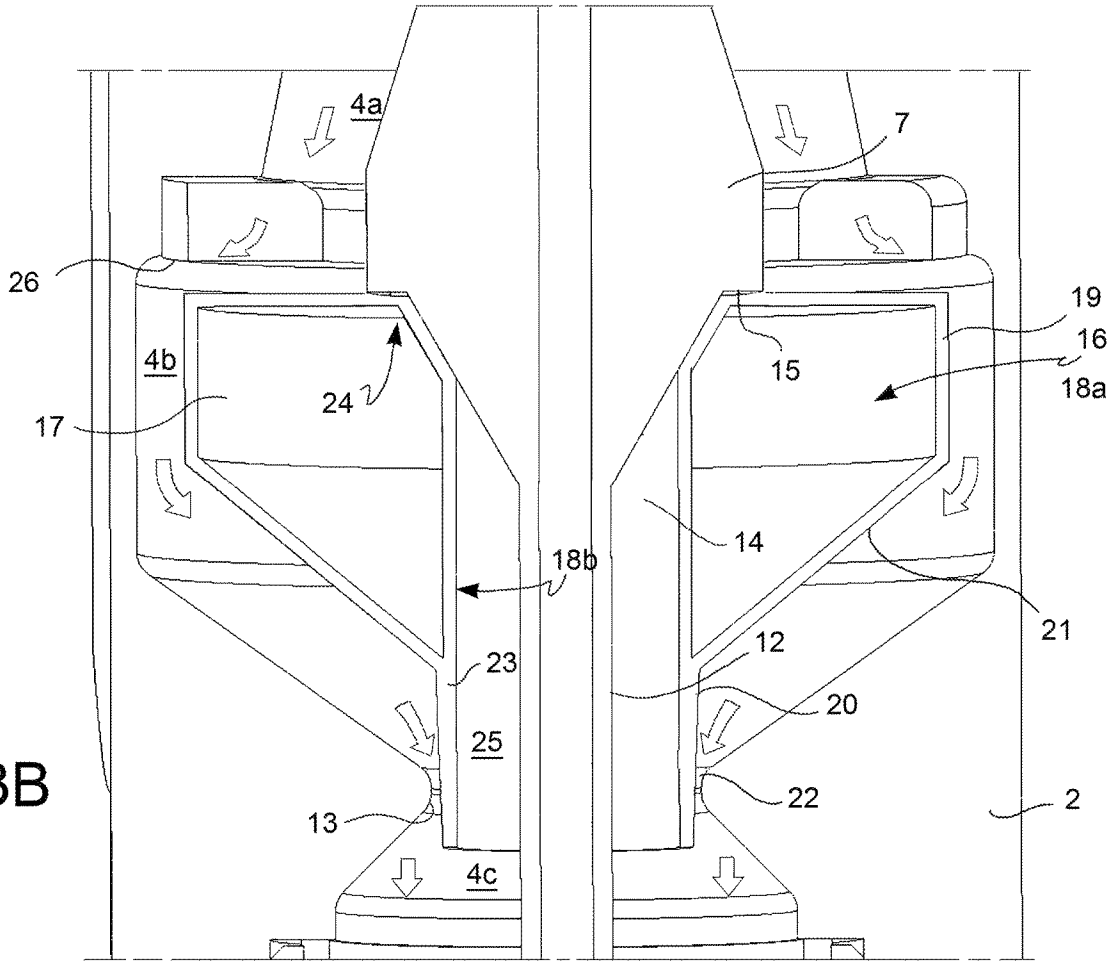
FIG. 3B shows a longitudinal section view of the detail in FIG. 3A.
Figure 4A:
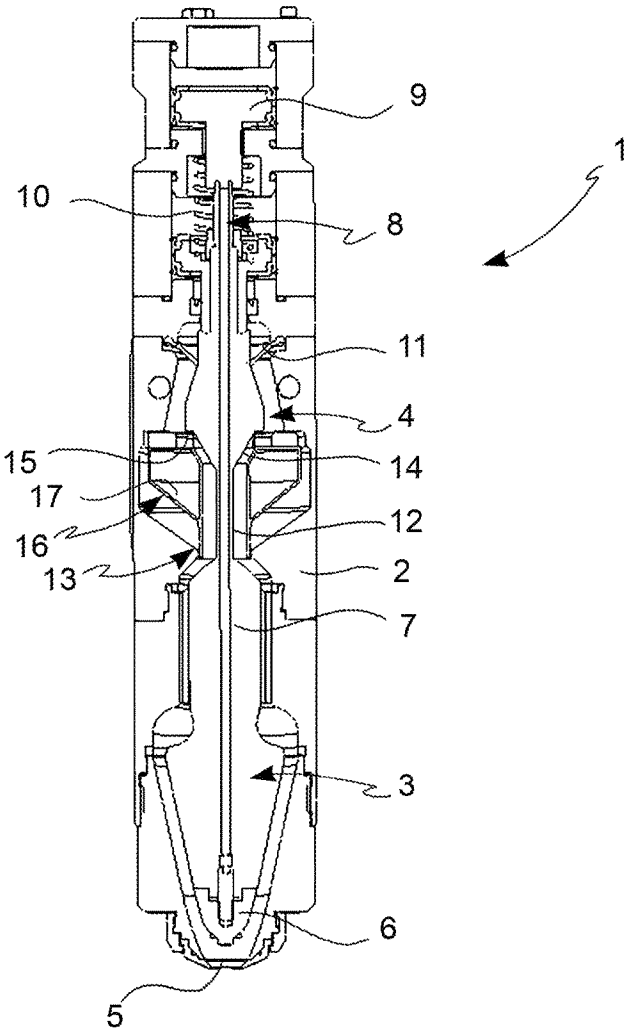
FIG. 4A shows a longitudinal section view of the valve in FIG. 1 in a second opened-valve operating condition.
Figure 4B:
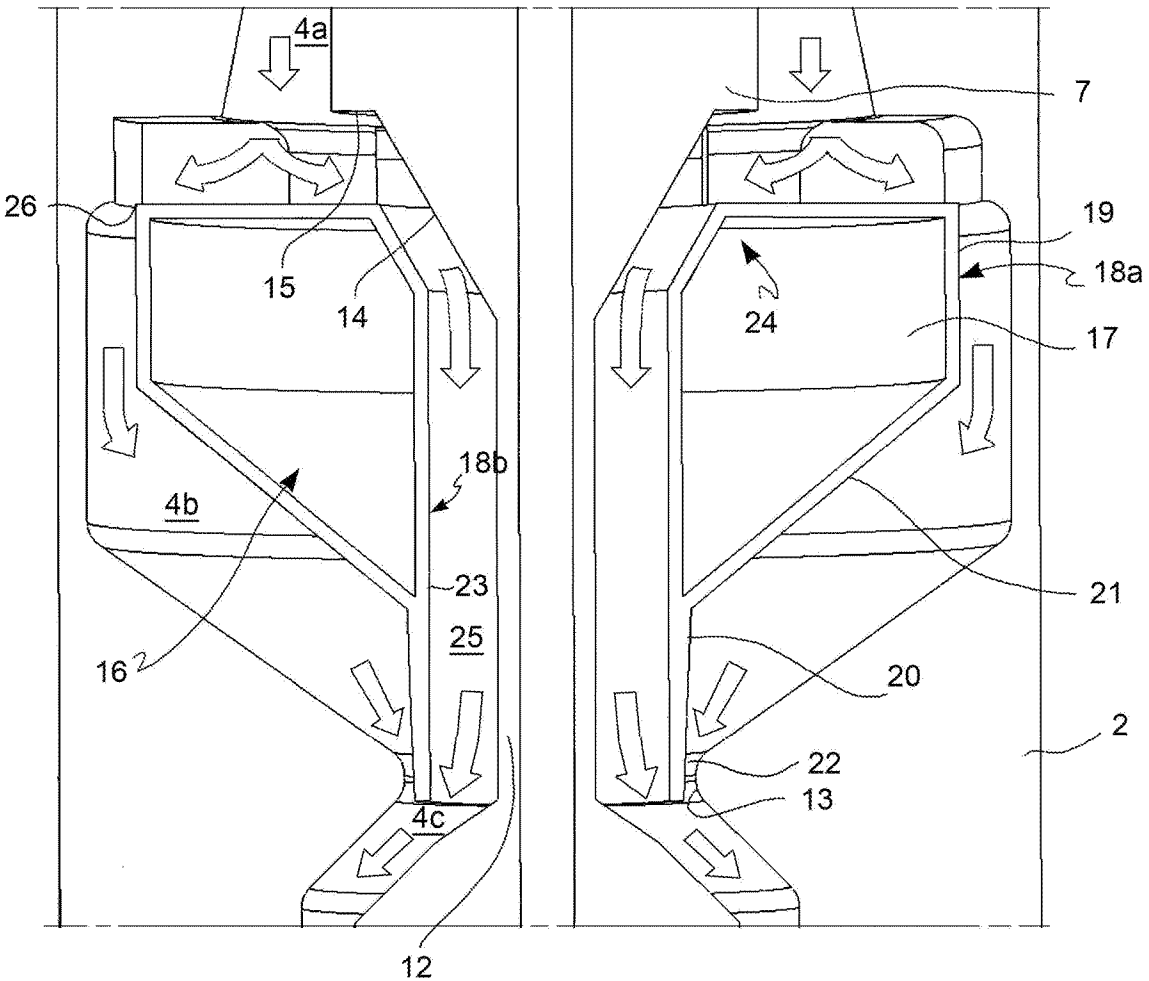
FIG. 4B shows a longitudinal section view of the detail in FIG. 4A.
Figure 5:
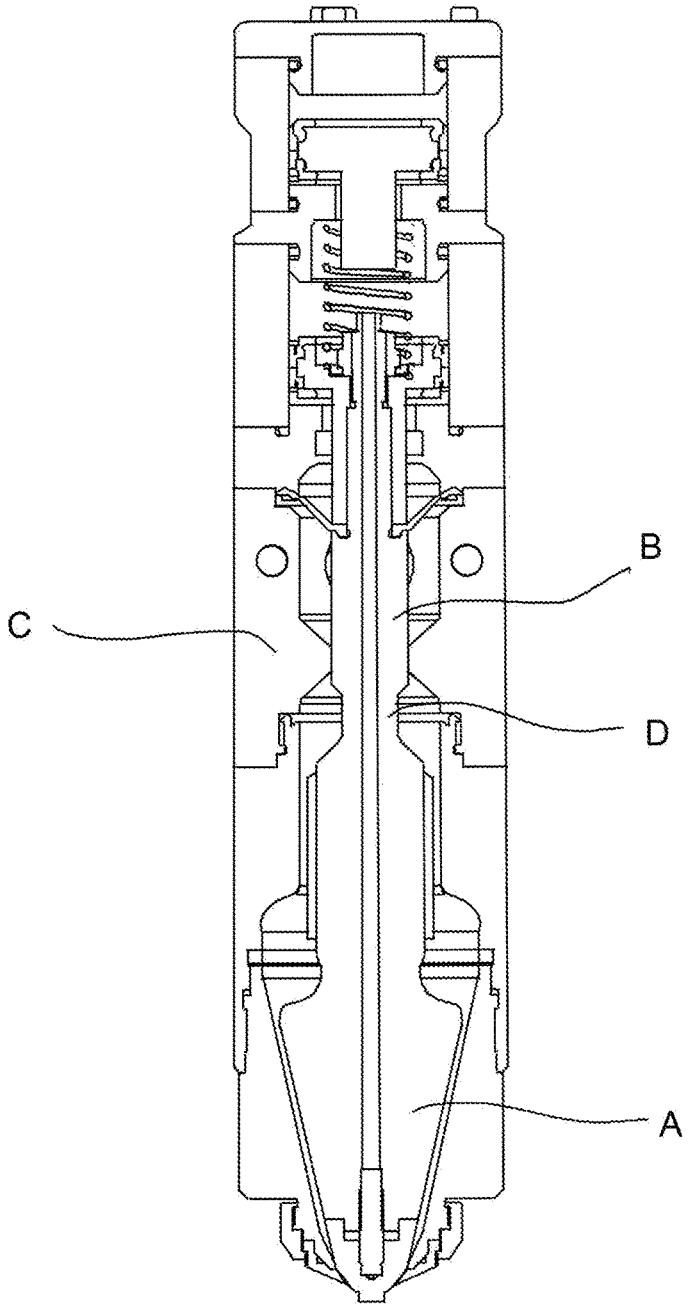
FIG. 5 ( PRIOR ART)
FIG. 5 shows a longitudinal section view of a filling valve of the prior art.

With reference to FIGS. 3B and 4B, the toroidal body 17 comprises an outer surface 18*a* and an inner surface 18*b*.

The outer surface 18*a* has a first cylindrical portion 19 with larger diameter and a second slightly conical portion 20 with smaller base diameter, connected by a conical portion 21.

The minimum diameter of the second slightly conical portion 20 is slightly smaller than the section of the narrowing 13 of cavity 4, so as to create a first toroidal channel 22 with a narrowed section which can vary according to the position taken by stem 7 in the various operating conditions for the filling fluid to pass outside the adjusting member 16, from the funnel portion 4*b* to the dispensing portions 4*c* of cavity 4. Furthermore, the axial extension of the second slightly conical portion 20 is such that it is always engaged in the first toroidal channel 22, in all operating conditions of valve 1.

The inner surface 18*b* of the adjusting member 16 has a cylindrical portion 23, which extends at the slightly conical portion 20 and at the conical portion 21 of the outer surface 18*a*, and a coupling portion 24 with stem 7.

The inner diameter of the cylindrical portion 23 of the adjusting member 16 is larger than the outer diameter of the reduced-section portion 12 of stem 7, so as to create a second toroidal channel 25 for the filling fluid to pass inside the adjusting member 16.

The coupling portion 24 has a conical profile having a taper matching the conical portion 14 of stem 7.

FIG. 1 shows valve 1 in a non-operative condition. The cavity 4 is empty and the adjusting member 16 rests at its bottom on the narrowing edge 13 of cavity 4.

FIG. 2 shows valve 1 in operation, but in the closing condition. The tip 6 of shutter 3 shuts the dispensing opening 5 of body 2. The cavity 4 is full of filling liquid and the dispensing member 16, under the bias of Archimedes' thrust, floats in the liquid and abuts against the conical portion 14 and the shoulder 15 of stem 7 by means of the coupling portion 24.

FIGS. 3A and 3B show the valve in operation, in a first opening condition. The actuation means 9 raise shutter 3, disengaging tip 6 from the dispensing opening 5, thus allowing the filling fluid to flow out from valve 1, passing through the first introduction portion 4*a*, the second funnel portion 4*b*, the first toroidal channel 22 outside the adjusting member 16, and the third dispensing portion 4*c*, respectively. In this operating condition, the adjusting member 16 remains abutting against the shoulder 15 of stem 7, so that the second toroidal channel 25 inside the adjusting member 16 remains obstructed. This operating condition causes a reduced flow rate of filling fluid and occurs during the final and conclusive steps of filling a container, thus allowing to either minimize or eliminate the formation of foam.

FIGS. 4A and 4B instead show valve 1 again in operation, but in a second opening condition. The actuation means 9 continue to raise shutter 3, but the adjusting member 16 abuts against the shoulder 26 of the inner surface of body 2 and thus stops its raising, disengaging itself from the step 15 and from the conical portion 14 of stem 7. However, the slightly conical portion 20 of the adjusting member 16 is not disengaged from the first toroidal channel 22 outside the adjusting member 16. Thereby, the second toroidal channel 22 inside the adjusting member 16 is pervious and the filling fluid can also pass therethrough, thus increasing the overall flow rate of the fluid which is dispensed by valve 1. This operating condition corresponds to the central step of filling, which thus occurs at a high speed.

As the end of filling approaches, the actuation means 9 return shutter 3 downwards. When the shoulder 15 of stem 7 abuts against the coupling portion 24 of the adjusting member 16, the latter, again under the bias of Archimedes' thrust, is integrally pushed downwards with stem 7, and the second toroidal channel 22 is simultaneously closed. This causes a decrease in the fluid flow rate so that there is no formation of foam during the step immediately before the closing of valve 1.

The filling valve 1 according to the invention may be mounted on any filling machine. A preferred example of filling machine is a net weight filling machine. In such machines, the container is associated with a weighing device in which the weight of the fluid to be dispensed to fill the container is set. The initial and final steps of dispensing, i.e. those requiring a reduced fluid flow to prevent the formation of foam, may thus be adjusted beforehand by setting a first and a second partial fluid weight which indicate the beginning and the end of the fast filling step.

The filling valve 1 according to the invention allows to obtain a high-speed filling, substantially higher than that of the devices of the known art, while avoiding the occlusion of the first toroidal channel 22 by solid residues. Indeed, the slightly conical portion 20 of the adjusting member 16 is never disengaged from the toroidal channel 22, thus preventing any solid residues from being inserted between the two walls.

It is apparent that only some particular embodiments of the present invention have been described, to which those skilled in the art will be able to make all the changes required to adapt it to particular applications, without thereby departing from the scope of protection of the present invention.

The invention claimed is:

1. A filling valve for filling machines comprising: a hollow body which encloses a cavity in which a filling fluid is introduced and which opens at a bottom of the cavity into a dispensing opening, a shutter being axially sliding in the cavity, wherein the shutter comprises a tip adapted to shut the dispensing opening, a stem, and an adjusting member for adjusting a flow rate of the filling fluid, characterized in that the adjusting member comprises a toroidal body arranged coaxially with respect to the stem and floating with respect thereto.

2. The filling valve according to claim 1, wherein the cavity comprises a first portion for introducing the filling fluid, a second funnel portion and a third dispensing portion which ends at the bottom of the cavity in said dispensing opening, wherein, between the second funnel portion and the third dispensing portion, the cavity has a cross-section narrowing and wherein the stem has a reduced-section portion at the narrowing of the cavity, the toroidal body of the adjusting member being arranged coaxially with respect to the reduced-section portion of the stem.

3. The filling valve according to claim 2, wherein the toroidal body of the adjusting member comprises an outer surface and an inner surface, the inner surface comprising a cylindrical portion and a coupling portion with the stem.

4. The filling valve according to claim 3, wherein, above the reduced-section portion, the stem has a conical portion which ends at a top with a shoulder and wherein the coupling portion of the adjusting member has a conical profile having a taper matching the conical portion of the stem.

5. The filling valve according to claim 3, wherein the outer surface of the adjusting member has a first cylindrical portion with larger diameter and a second slightly conical portion with smaller base diameter, connected by a conical portion, the minimum diameter of the second slightly conical portion being slightly smaller than the section of the narrowing of the cavity, so as to create a first toroidal channel with narrowed section for the filling fluid to pass outside the adjusting member.

6. The filling valve according to claim 5, wherein an axial extension of the second slightly conical portion is such that it is always engaged in the first toroidal channel, in all operating conditions of the valve.

7. The filling valve according to claim 3, wherein an inner diameter of the cylindrical portion of the adjusting member is larger than an outer diameter of the reduced-section portion of the stem, so as to create a second toroidal channel for the filling fluid to pass inside the adjusting member, said second toroidal channel being pervious only when the coupling portion of the adjusting member is disengaged from the stem.

8. The filling valve according to claim 1, wherein the stem has an upper portion operatively connected to actuation means of the shutter, said actuation means being preferably selected from a pneumatic actuator and a direct drive linear motor.

9. The filling valve according to claim 1, wherein an upper portion of the stem is separated from the cavity by means of an annular-shaped sealing membrane.

10. The filling valve according to claim 2, wherein, between the first and the second portions of the cavity, the body comprises a downward-facing shoulder, adapted to abut against the adjusting member when it is freely pushed upwards by Archimedes' thrust.

11. A filling machine comprising at least one filling valve according to claim 1.

12. The filling machine according to claim 11, said filling machine being a net weight filling machine.

* * * * *